US010058831B2

(12) United States Patent
Telljohann et al.

(10) Patent No.: US 10,058,831 B2
(45) Date of Patent: Aug. 28, 2018

(54) MIXING DEVICE COMPRISING AT LEAST FOUR OUTLET ARMS HAVING DIVERSE VERTICAL ANGLES

(71) Applicant: Windmöller & Hölscher KG, Lengerich (DE)

(72) Inventors: Lutz Telljohann, Lengerich (DE); Andreas Ihme, Lengerich (DE); Frank Hasselmann, Osnabrück (DE); David Trinkner, Lengerich (DE); Frank Twiehaus, Westerkappeln (DE); Holger Hoffmann, Ibbenbüren (DE); Lars Pockehr, Emsdetten (DE); Udo Lepper, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 802 days.

(21) Appl. No.: 14/398,510

(22) PCT Filed: Apr. 30, 2013

(86) PCT No.: PCT/EP2013/059013

§ 371 (c)(1),
(2) Date: Nov. 3, 2014

(87) PCT Pub. No.: WO2013/164349

PCT Pub. Date: Nov. 7, 2013

(65) Prior Publication Data

US 2015/0103619 A1 Apr. 16, 2015

(30) Foreign Application Priority Data

May 2, 2012 (DE) ..... 10 2012 103 848

(51) Int. Cl.

| | |
|---|---|
| ***B01F 5/10*** | (2006.01) |
| ***B01F 5/00*** | (2006.01) |
| ***B01F 5/02*** | (2006.01) |
| ***B01F 13/02*** | (2006.01) |
| ***B41F 31/02*** | (2006.01) |

(Continued)

(52) U.S. Cl.
CPC ..... *B01F 5/108* (2013.01); *B01F 5/0062* (2013.01); *B01F 5/0206* (2013.01);
(Continued)

(58) Field of Classification Search
CPC ..... B01F 5/108
(Continued)

(56) References Cited

U.S. PATENT DOCUMENTS 1,156,946 A 10/1915 Vandercook
1,192,478 A 7/1916 Vandercook
(Continued)

FOREIGN PATENT DOCUMENTS

DE 1280165 10/1968
DE 19923378 11/2000
(Continued)

OTHER PUBLICATIONS

Seefried, Erwin. Espacenet Translation of DE19923378C2. Patent Translate Powered by EPO and Google. All Pages. (Year: 2003).*
(Continued)

*Primary Examiner* — Abbas Rashid

(57) ABSTRACT

The invention relates to a mixing device for mixing a fluid in a container, in particular of a fluid system, comprising a fluid supply and at least one outlet arm with an outlet opening, the fluid supply being connected to the at least one outlet arm in a fluid-communicating fashion. According to the invention, the outlet opening, for an outlet of the fluid, is oriented towards an outlet direction in order to set the fluid in the container rotating at least in sections thereof.

7 Claims, 5 Drawing Sheets

(51) Int. Cl.
*B41F 31/03* (2006.01)
*B41F 31/06* (2006.01)
*B41F 31/08* (2006.01)

(52) U.S. Cl.
CPC ..... *B01F 5/0231* (2013.01); *B01F 5/10* (2013.01); *B01F 13/02* (2013.01); *B01F 13/0216* (2013.01); *B41F 31/02* (2013.01); *B41F 31/03* (2013.01); *B41F 31/06* (2013.01); *B41F 31/08* (2013.01); *B01F 2215/005* (2013.01); *B41P 2251/10* (2013.01)

(58) Field of Classification Search
USPC ..... 366/103, 104, 107, 162.2, 165.1, 165.3, 366/167.2–169.1, 170.3, 172.1, 366/173.1–173.2, 177.1–178.2, 181.6, 366/262–263, 265
See application file for complete search history.

(56) References Cited

U.S. PATENT DOCUMENTS

| | | | | |
|---|---|---|---|---|
| 4,235,552 | A | 11/1980 | Underwood | |
| 4,527,479 | A | 7/1985 | Dahlgren et al. | |
| 6,109,778 | A | 8/2000 | Wilmer | |
| 6,164,332 | A | 12/2000 | Hatton | |
| 6,488,402 | B1 * | 12/2002 | King | B01F 3/0446 366/173.2 |
| 2003/0025221 | A1 | 2/2003 | Shane | |
| 2008/0223618 | A1 | 9/2008 | Warren | |
| 2011/0318471 | A1 * | 12/2011 | Anand | A23B 7/02 426/615 |

FOREIGN PATENT DOCUMENTS

| | | |
|---|---|---|
| EP | 0555672 | 8/1993 |
| EP | 0780228 | 6/1997 |
| FR | 358539 | 2/1906 |
| GB | 1163780 | 9/1969 |
| WO | WO 2010/034660 | 4/2010 |
| WO | WO 2013/164349 | 11/2013 |

OTHER PUBLICATIONS

International Search Report dated Nov. 26, 2013 From the International Searching Authority Re. Application No. PCT/EP2013/059013 and Its Translation Into English.

* cited by examiner

Fig. 3
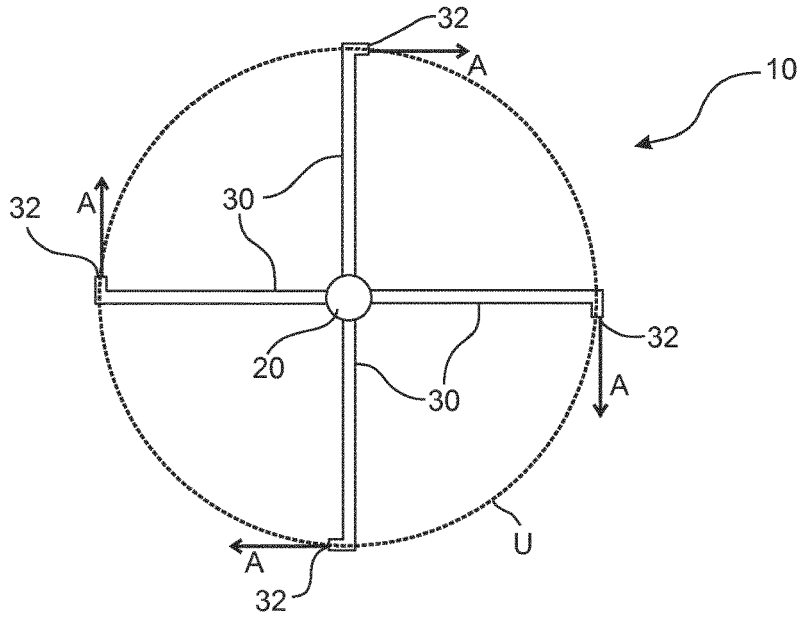
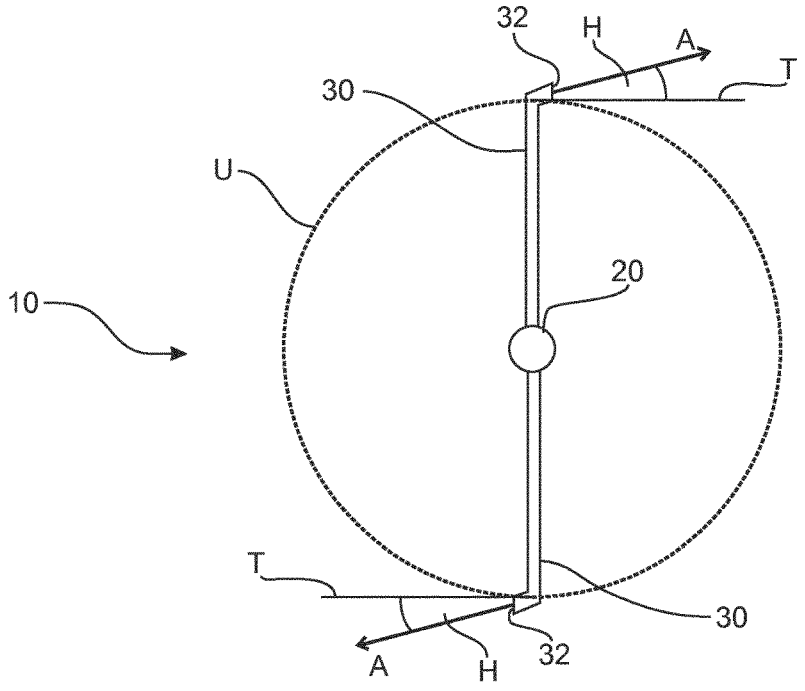
Fig. 4

MIXING DEVICE COMPRISING AT LEAST FOUR OUTLET ARMS HAVING DIVERSE VERTICAL ANGLES

RELATED APPLICATIONS

This application is a National Phase of PCT Patent Application No. PCT/EP2013/059013 having International filing date of Apr. 30, 2013, which claims the benefit of priority of German Patent Application No. 10 2012 103 848.1 filed on May 2, 2012. The contents of the above applications are all incorporated by reference as if fully set forth herein in their entirety.

FIELD AND BACKGROUND OF THE INVENTION

The present invention regards to a mixing device for mixing a fluid in a container, particularly for a fluid system, a fluid system, particularly for dyes in a printing machine, as well as a method for mixing a fluid in a container, particularly of a fluid system.

Mixing devices for mixing a fluid in a container are basically known. They are established particularly with fluid systems, for example for dyes in a printing machine. Thereby a rotatable stirrer is intended, for example with a printing machine, which arranges for a stirring of a fluid in a container using an actuated drive shaft. Therefore a separate gear for the stirring device is necessary. For example by using dyes in a printing machine the stirring is mandatory, in order to introduce shearing forces into the fluid. Particularly with dyes, which comprise thixotropic properties, a reduction of the viscosity is achieved not until inserting shear forces by using known stirring institutions. Only by the reduction of the viscosity a processing or a pumping of the dye can occur. Another reason for the necessity of stirring the fluid is the provision of fluid mixtures. For example additives in the fluid are intended, particularly in the dye, which are preferable homogenously distributed. Such additives can be waxes for an improved surface structure, color correction in form of pigment containing additional fluids or solvents. The more homogenously the distribution in the fluid in the container occurs, the more homogenously the print image in the printing machine will be exhibited during the process of the printing process.

It is a disadvantage of known mixing devices, that a high constructive effort is necessary to ensure the stirring. Therefore, separate stirring devices or stirring units are necessary to achieve the stirring. This requires additional gears, for example in form of electric motors. Rotational mounting for the corresponding drive shaft of the stirring unit must also be intended. Since particularly with containers for fluid systems of a printing machine a simple cleaning should be given, such rotating elements implicate an immense cleaning effort. Moreover the gear for such a stirring unit or the stirring unit itself requires additional construction space, which is lost for other utilization possibilities in the corresponding machine. Not least the intention of an additional gear, as well as the additional stirring unit, increases the cost effort during the production of such a fluid system or such a mixing device.

SUMMARY OF THE INVENTION

Therefore it is the objection of the present invention, to at least partially dissolve the subsequently described disadvantages. Particularly it is the objection of the present invention to provide a mixing device for mixing a fluid in a container, a fluid system as well as a method for mixing of a fluid in a container, which in a cost efficient and simple manner allows a stirring of the fluid in the container in a preferable homogeneous way.

The preceding objection is solved by a mixing device, a fluid system as well as a method as described in the description and the drawings. Thereby the features and details which are described in relation with the mixing device according to the invention apply naturally also in relation with the method according to the invention and the fluid system according to the invention and vice versa, so that it can always be alternately referred to according to the disclosure of the single aspects according to the invention.

A mixing device according to the invention serves for mixing a fluid in a container, particularly of a fluid system. The mixing device comprises a fluid supply and at least one outlet arm with an outlet opening. Thereby the fluid supply is connected with at least one outlet arm in a fluid communicating way. A mixing device according to the invention is characterized in that the outlet opening for an outlet of the fluid is aligned in the outlet direction, in order to at least partially set the fluid in the container in rotation. The rotation of the fluid in the container is intended as a rotational movement of individual volumes of fluid in the container. It is particularly a matter of a forced convection from the discharged fluid. Thereby a stirring or a twisting of individual volumes of fluid among each other occurs, without the necessity of rotating components. A mixing device according to the invention preferably takes the advantage that by corresponding application for a fluid system a turnover or a circular flow is frequently intended. As the mixing device for example applied for the fluid system of a printing machine, a suction of the fluid from the shaped container as a storage container occurs in direction of the printing machine. At the same time a return transport of the excessive fluid back to the container occurs. As such a circuit occurs during the operation of the fluid system. This circuit is initially used to ensure the stirring of the fluid. Thereby additional components as stirring units are resigned. According to the invention a fluid supply is intended, which is conveyed with a fluid composition from for example a pumping device of a circuit for the fluid. Thereby the fluid supply is shaped for example pipe-like or as a pipeline. In the free cross section in the inside of the fluid supply the fluid can float in the direction of the outlet arms or in the direction of the outlet openings.

It is at least one outlet arm intended which is connected with the fluid supply in a fluid communicating way. This means, that the fluid from the fluid supply can reach or is pumped from the fluid supply through the outlet arm to the outlet opening. Thereby the outlet arm extends preferably at least partially radial or mainly radial away from the fluid supply. The fluid supply is assembled particularly perpendicularly in depth direction of the container, so that the conveyance of the fluid is conducted in the direction of the bottom of the container. Therefore the outlet arm serves preferably for the conveyance transverse in the depth direction of the container, so that it is conveyed in the direction of the container wall. The outlet opening with an outlet direction according to the invention serves for at least partially setting of the fluid in the container in rotation.

With a mixing device according to the invention additional stirring units are resigned because the container arranges its own stirring. This is due to the fact that it is set in rotation in a manner according to the invention. During the rotation of the fluid, the fluid stirs itself. This rotation is particularly about a restraint convection of the fluid in the container, which is pushed or activated by eliminated fluid from the outlet openings of the outlet arms.

The rotation of the fluid in the container is mainly or exactly symmetrical, so that an at least partially continuous and consistent stirring of the fluid in the container occurs.

A mixing device according to the invention can be used in continuous operation by a printing machine of a fluid system and also for the preconditioning previous to the application of the fluid system in form of a printing machine. It is necessary that a relative movement of single volume elements of the fluid in the container is produced through the outlet of the fluid in the outlet direction from the outlet openings according to the invention.

The outlet direction is particularly at least partially adjusted in conveyance direction or mainly in conveyance direction of the container. This is particularly referred to the mainly cylindrical container. In a cylindrical container the conveyance direction is assembled alongside a tangent at a circular line. A corresponding inner circular line is assembled radially shifted in which direction the outlet direction of the fluid at the outlet opening is at least partially directed. Accordingly a preferably tangential outlet alongside the inner outlet line occurs, so that a rotation of the fluid in the container is intended, which proceeds mostly alongside or parallel to the exterior wall of the cylindrical container.

For a mixing device according to the invention at least one outlet arm or particularly the outlet opening of at least one outlet arm is assembled below the fluid level within the container. If it is about a storage container which is slowly depleted during the process of the operation of the fluid system the outlet opening is assembled preferably in depth direction particularly near to the bottom of the container, in order to keep an effectiveness of the mixing device as long as possible also during the falling of the fluidity level.

According to the invention different angles can be defined, as it is explained afterwards, in order to exactly adjust the outlet direction. Thereby it is particularly avoided that an angle is effected towards the neighboring container wall of the container towards the outlet direction, which comprises 90°. Moreover this angle is chosen preferably smaller than 90°, particularly smaller than 85°.

By the fluid according to the present invention particularly a dye or a dye composition is understood. Such dye composition can mainly comprise liquid components but also solid components as for example pigments. Naturally the fluid of the mixing device according to the invention can also be a flowable solid material or a fluid-like powder.

By a rotation which is produced with a mixing device according to the invention in the fluid in the container besides a stirring a sedimentation of solid components or a sedimentation at the bottom of the container is avoided. If the fluid is a dye or a dye composition in this way a sedimentation or a dye slurry at the bottom can be avoided.

It has to be noted, that the mixing device according to the invention can implement a second function, namely the necessary recycling of excessive fluid from the fluid system. In this way a mixing device according to the invention can provide a double function without additional equipment for example in form of stirring units.

In order to assure a sufficient volume flow for example in the area of approximately 18 l/min by a fluid supply, preferably outlet cross sections or free fluid flow cross sections of the outlet arms/outlet openings can be applied in the area between approximately 2 mm and approximately 10 mm, preferably in the area of approximately 6 mm+/−2 mm.

By the fluid supply and by at least one outlet arm preferably a fixed construction component in relation to one another or in relation to the container are intended. Particularly the mixing device is formed in a way that can be assembled rotation-stable at the container.

It can be an advantage, if the mixing device according to the invention with at least one outlet arm extends at least partially perpendicular or mainly perpendicular to the fluid supply. The outlet arm is preferably radial or mainly radial adjusted away from the fluid supply if a mainly cylindrical shape of the container is intended. Accordingly an approximation at the conveyance direction for the outlet direction is intended which is aligned parallel towards the conveyance direction of the container.

It is further advantageously if at the mixing device according to the invention at least one outlet arm is at least partially curved. Thereby the fluid can be guided radially from the fluid supply towards outside, and there it can be guided in the desired outlet direction via the curve. Particularly during the fluid supply which is parallel and/or coaxial shaped towards the container axis of the container this shape is advantageously. The flection can occur alongside a curve and also acute angled. Particularly with a shaping of a plurality of outlet arms all outlet arms are curved in the same direction. Thereby a shape of the outlet arms can be intended in a spider-like or spiral manner which enables a continuous pushing of the rotation of the fluid in the container. At the same time the outlet arms are preferably provided with an external cross section which includes a preferably small influence on the surrounding flow. Preferably the external cross section of the single outlet arms is round. Such a cross section is moreover particularly easy to clean.

It is also advantageously if the outlet opening of the mixing device according to the invention is assembled for the outlet direction of the fluid with a vertical angle and/or a horizontal angle, wherein the vertical angel and/or the horizontal angle are smaller than 90°, particularly smaller than approximately 85°. With these angles it is about exact angle specifications, which enable an adjustment of the outlet direction. Therefore, by the horizontal angle an angle is described, which extends mainly in a horizontal layer according to the container. The vertical angle is particularly an angle which extends in one layer which is parallel towards the container axis. Thereby two angles can be intended which comprise a characteristic of smaller than 90° so that an outlet direction exactly towards the bottom of the container or exactly towards the wall of the container can be avoided. All other angle adjustments of the outlet direction are possible according to the invention so that a rotation of the fluid in the container is initiated. In the normal case particularly small angles are frequently initiated in order to provide a particularly efficient generation of a rotation of the fluid in the container. Therefore, vertical angles and horizontal angles are particularly intended in the area of smaller then approximately 60°, preferably in an area of approximately smaller than 45°, particularly preferably in an area from 0° to approximately 30°. The turning in a vertical direction can lead to the fact that given volumes in the area of the bottom of the container can be efficiently rinsed. In accordance with the adjustment of the single outlet direction corresponding variations of the rotation of the fluid in the container can be achieved so that an explicit adjustment of the fluid dynamic within the container occurs. Naturally the outlet direction of single outlet arms with the plurality of outlet arms of a mixing device can be shaped differentially so that complex fluid stream can be generated in a defined manner.

Moreover it is an advantage if by the mixing device according to the invention at least two outlet arms with each an outlet opening are intended, wherein the outlet openings comprise different vertical angles particularly with different signs towards the horizontal level. The horizontal level is thereby formed by a level, which is mainly parallel towards the bottom area of the container. Thereby a vertical angle of more than 0° and less than 90° means an adjustment of each outlet opening towards the bottom area or away from the bottom area. By the contribution of fluid a blistering can occur and thereby a foam forming on the surface of the fluid in the container. In order to avoid this in this embodiment an adjustment of the outlet openings upside and/or downside is intended. Thereby an improved distribution of the fluid is achieved, whereby the foam forming is reduced or even completely avoided. The vertical angles are thereby intended according to the direction of the outlet opening upside or downside with different signs towards the horizontal level. For a reduction of the foam forming it can be an advantage, if at least one outlet opening comprises an orientation away from the bottom area of the container. Preferably by an orientation upwards and downwards the amount of vertical angles with different vertical angles are even or mainly even.

It is moreover advantageously when all outlet openings of the mixing device according to the invention comprise alternating different signs of the vertical angles towards horizontal level in conveyance direction. This means, that for example one or two outlet openings downwards and afterwards in conveyance direction one or two outlet openings upwards are alternately aligned. Thereby a preferably effective axial distribution of the inserted fluid is achieved. Foam forming on the surface of the fluid in the container is thereby further diminished or even completely prevented.

Moreover it is advantageously if the vertical angles below the horizontal level of the mixing device according to the invention are intended in an area between approximately 2° and approximately 7° and/or the vertical angles above the horizontal level in the area between 10° and approximately 20°. Thereby the amount of the respective vertical angle is meant. According to the observation direction the vertical angles comprise a positive (towards the bottom of the container) and in the other direction a negative (away from the bottom of the container) sign. This angle range represents advantage embodiments, since in this way a reduction of the foam forming can be combined with a rotation of the fluid in the container.

It is moreover advantageously if at least two outlet arms are intended with a mixing device according to the invention which are aligned for the outlet direction of the fluid alongside a common coverage. Thereby the outlet directions build a circular line along which the main rotation of the fluid in the container is intended. The number of outlet arms can be for example 2, 3, 4, 5, 6 or even more outlet arms. These single outlet arms can be assembled evenly or unevenly in conveyance direction. The number of arms is preferably adapted to the size of the corresponding container so that with small containers a small number of outlet arms and with big containers a greater number of outlet arms can be intended. Thereby the size is mainly aligned with the inner cross section of the container so that with a big inner cross section a frequent pushing of the rotation of the fluid in the container by the corresponding plurality of outlet arms and outlet openings occurs. If a plurality of outlet arms is intended cross means between the single arms and/or for the fluid supply for stabilization of the outlet arms and the fluid supply can be applied.

The single arms are preferably symmetrically distributed so that an easy production is possible. The single outlet arms can be produced as standard components and afterwards combined to a mixing device according to the invention. The outlet arms can be produced for example from metal, particularly steel, and assembled at the fluid supply, particularly welded.

Moreover it can be advantageously if for a mixing device according to the invention at least two outlet arms are intended, which are evenly or mainly evenly distributed around the fluid supply. The even conveyance distribution leads to the fact that the production effort is further diminished. Moreover in this manner a particularly even influence of the occurring rotation stream of the fluid in the container occurs. Therefore it occurs particularly an even pushing of the fluid so that an even and continuous rotation of the fluid in the container is intended.

It is further advantageously when at least two outlet arms are intended by a mixing device according to the invention which extend at least partially in the same level. This also reduces the effort during the production. Particularly a slice-like formation of the outlet arms is intended so that a particularly low undesired influence in form of current disturbance by the outlet arms itself can be achieved by the mixing device according to the invention.

It can further be of advantage, when the fluid supply of a mixing device according to the invention is intended in order to extend in the container along or parallel to the container axis, particularly until the lower half of the container. Preferably the extension in the lower half of the container leads to the fact that during a continuous decline of the fluid level within the container a rotation of the fluid in the container according to the invention is enabled. Particularly the extension along or parallel to the container axis leads to the fact that at the same time a mounting of the outlet arms in the desired height in the container occurs via the fluid supply. Particularly the rotation of the lower half of the fluid in the container leads to the fact that in the area of extraction the desired stirring concerning the distribution of viscosity or a stirring of single components of the composition of the fluid occurs in a pump pit in the container.

Another advantage is achieved by the fact that the fluid supply comprises at least one additional opening in the area of the connection to the at least one outlet arm, in order to avoid clearance volume in this area. The at least one additional opening can be directed in each desired direction concerning its outlet direction, also particularly radial, tangential or axial in reference to the adjustment of the fluid supply and/or the axis of the container. In this way possibly arising clearance volumes in the connection area between the at least one outlet arm and the fluid supply can be avoided or reduced with little or no movement of the fluid. For example the fluid supply can comprise a closure at its lower end, preferably in form of a lid, which comprises at least one additional opening. Also a formation of the at least one additional opening above the connection at the at least one outlet arm is possible in the scope of the present invention, so that the risk of a formed clearance volume also above the connection area can be avoided. With other words in this manner an additional swirling of the fluid can occur, whereby the quality of the stirring of the fluid in a manner according to the invention is further enhanced.

Another subject of the present invention is a fluid system, particularly for dyes in a printing machine, comprising at least one container for the storage of a fluid. Further a flow pump and return flow pump for the conveyance of the fluid is intended. It is also intended that a fluid receptor particularly a print roller and a fluid tank for the provision and/or collection of the fluid for and/or from the fluid receptor. Thereby a flow pump is formed for a conveyance of the fluid from the container to the fluid receptor and the return flow pump is formed for conveyance of the fluid from the fluid tank back to the container. The fluid system according to the invention is characterized in that a mixing device with the features according to the present invention is intended wherein the fluid supply of the mixing device is connected with the pressure side of the return flow pump in a fluid communicating way. The fluid system according to the invention can for example be used for printing machines and serves for maintenance of a dye circle. Thereby dye is supplied in the container which is conveyed via the flow pump for example to a print roll of a printing machine. The removed spare dye which is removed from a doctor is collected in a fluid tank and is conveyed back to the container via a return flow pump. This basic functionality of the dye circuit is now additionally used for stirring the dye within the fluid according to the invention. Thereby the dye in form of a fluid is conveyed via the fluid supply of the mixing device according to the invention for the rotation of the fluid in the container. By this embodiment according to the invention the mixing device brings about a fluid system according to the invention with the same advantages, which are explained in detail according to the mixing device according to the invention. The suction via the flow pump occurs particularly in a pump pit in the bottom or near the bottom of the container.

By a print roller according to the present invention particularly a roller is intended which is shaped as a dye transmission roller. It serves for transmitting the fluid in form of a dye to the to be printed medium as a last roller.

The fluid system according to the invention can be developed in a way that the pressure side of the flow pump is connected with the sucking side of the return flow pump via a bypass in a fluid communicating way. This bypass enables a stirring according to the invention also independent from the great circuit via the fluid receptor, particularly in form of a print roller. Thereby the pre-convectioning can be made without activating the whole fluid system with the fluid receiver thus the whole printing machine. If a container is recently filled, a small circuit can be ensured previous to the start of the printing process via the bypass via the flow pump and the return flow pump, which ensures a pre-stirring by the formation of a rotation of the fluid in the container with a mixing device according to the invention. Thereby preferably at least three valves are intended which are assembled as a flow-valve past the connection at the bypass and past the flow pump, as return flow-valve past the connection of the return flow pump and the bypass and as bypass valve in the bypass.

Likewise it is advantageously if the outlet openings of the at least one outlet arm of the fluid system according to the invention are assembled between approximately 20% and approximately 80% of the radial distance between the fluid supply and the surrounding wall of the container. The more the outlet opening of the outlet arm is assembled towards the outside, the higher is the influence of the rotation of the fluid in the container, because the lever towards the axis of rotation in the container is increasing. Preferably the higher is also the flow rate, in order to overcome the corresponding lever arm and the therewith corresponding force for the rotation of the fluid in the container.

Likewise it can be advantageously if the mixing device of the fluid system according to the invention is assembled in a rotation stable way to the container. Thereby for example flange connections can be used, as they are known by known containers for the recirculation of the waste fluid. A mixing device according to the invention can thereby be upgraded by a previously known fluid system.

Another embodiment of the present invention is a method for mixing a fluid in a container, particularly a fluid system with a mixing device. Such a method according to the invention comprises at least the following steps:

Inserting a fluid from an outlet opening of at least one outlet arm in the container with an outlet direction, which is adjusted to at least partially set the fluid in the container in rotation.

A method according to the invention is particularly developed in a way that it is formed for the mixing of a fluid for the fluid system according to the invention. Thereby the method according to the invention bears the same advantages like they are described in detail according to the fluid system according to the invention and according to the mixing device according to the invention.

Likewise it is advantageously when for the pre-convectioning of the fluid in the container with a method according to the invention air is inserted, particularly intermittently from the outlet opening of the at least one outlet arm in the container. Is a fluid tank intended for example in a fluid system, air can be absorbed from this empty-sucked fluid tank, wherein this air sucking can be opened or closed via corresponding valves. Thereby the air can preferably intermittently be ejected via the outlet opening of the outlet arm alternately with the fluid. While the fluid from the outlet opening abuts the rotation of the fluid in the container, the air is raising within the fluid during the rotation of the fluid in the container. By rising an additional forced convection from the volume element within the fluid in the container occurs in vertical direction upwards so that an additional stirring direction is achieved. The synchronized intermittently insertion of air can preferably occur between approximately 2 seconds and approximately 10 seconds.

BRIEF DESCRIPTION OF THE DRAWINGS

The present invention is described in more detail according to the corresponding drawings. Thereby used terms "left", "right", "up" and "down" are referring to an adjustment of the drawings with normally readable references. It is shown schematically:

FIG. 3 an embodiment of a mixing device according to the invention,

FIG. 4 another embodiment of a mixing device according to the invention,

DESCRIPTION OF SPECIFIC EMBODIMENTS OF THE INVENTION

Figure 1:
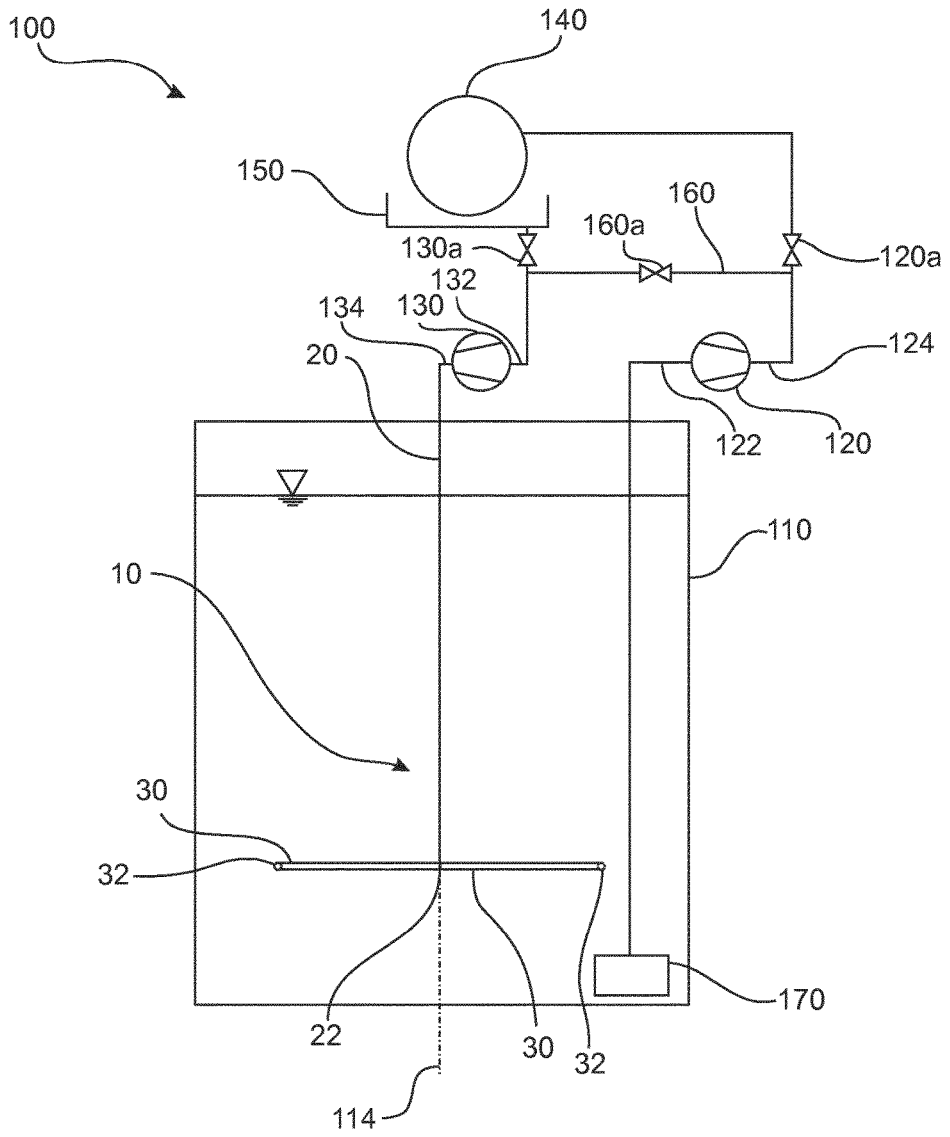
FIG. 1 an embodiment of a fluid system according to the invention.

In FIG. 1 a first embodiment of the fluid system 100 according to the invention is shown. Thereby it is preferably a part of a printing machine. Thereby a fluid receptor 140 is intended which for example can be shaped as a printing roller or a pattern roller of a printing machine, particularly a flexographic printing press or a rotary printing press. Via a flow pump 120 fluid, particularly a dye composition is conveyed from a container 110 to a fluid receptor 140. Via a now shown extractor device in form of a doctor the excessive fluid is drawn from the fluid receptor 140, and collected in a fluid tank 150. Via the return flow pump 130 the collected fluid from the fluid tank 150 is recycled in the container 110. Thereby it is a normal fluid circuit or a working circuit of the fluid.

In the fluid system 100 according to FIG. 1 the whole performance as well as the performance of a mixing device 10 according to the invention occurs. Thereby a mixing device 10 is supplied with a fluid supply 20 which is connected to a plurality of outlet arms 30 in a fluid communicating way. Each of the outlet arms 30 comprises an outlet opening 32 which comprises an outlet direction A (not shown in FIG. 1), in order to set the fluid in the container 110 in rotation. Thereby the subsequently described circuit in a fluid system 100 according to the invention is enabled.

In the beginning of the printing method the fluid receptor 140 is supplied with a dye. This enabled by operating the flow pump 120, and the generation of a low pressure at the pump pit 170 on the sucking side 122. The fluid is thereby sucked at the pump pit 170 via the flow pump 120 and conveyed in direction of the pressure side 124 towards the fluid receptor 140. There, the printing procedure occurs. Excessive fluid or excessive dye is collected in the fluid tank 150 and is sucked by the return flow pump 130 via the suction side 132. Via the pressure side 134 which is in a fluid communicating connection with the fluid supply 20, dye or fluid is inserted in the mixing device 10 and radially distributed towards the outside via the outlet arm 30. The outlet occurs via the outlet openings 32 so that the fluid within the container 110 is set into rotation. The whole mixing device, particularly the outlet arms 30 are assembled rotation stable relative towards the container 110. By rotation of the fluid in the container 110 a stirring of the fluid occurs, so that during the dye composition with thixotropic characteristics the viscosity is reduced by the insertion of these shear forces. Additional installations as for example stirring units are not necessary.

Besides the execution of the printing procedure itself and the corresponding stirring according to the invention, a pre-conditioning can occur independent from an application of fluid of the fluid receptor 140. Thereby three valves 120*a*, 130*a* and 160*a* are intended. For the pre-conditioning the valves 120*a* (flow valve) and 130*a* (return flow valve) are shut and the bypass valve 160*a* is opened for example after filling of the container 110 with fluid and previously to the start of the printing procedure. Both pumps 120 and 130 thereby ensuring a small circuit, which ensures a circulation of the fluid independently from the fluid receptor 140. Thereby a stirring according to the invention can occur as a pre-conditioning. If during this pre-conditioning additionally for example intermittently, the return flow valve 130*a* is opened, air is sucked from the empty fluid tank 150. This intermittent sucking can occur with for example with a pulsing of approximately 2 seconds to approximately 10 seconds so that beneath the fluid also air packages are intermittently delivered from the outlet openings 32 of the outlet arms 30. These air packages are rising upwards in a vertical direction and thereby further ensure a vertical stirring.

Moreover the mixing device 10 of FIG. 1 is formed in a way that the lower closure of the fluid supply 20 is provided with an additional opening 22. This is particularly adjusted with an outlet direction alongside the container axis 114 so that eventually formed clearance volumes below the closure area between the fluid supply 20 and the outlet arms 30 are avoided or reduced.

Figure 2:
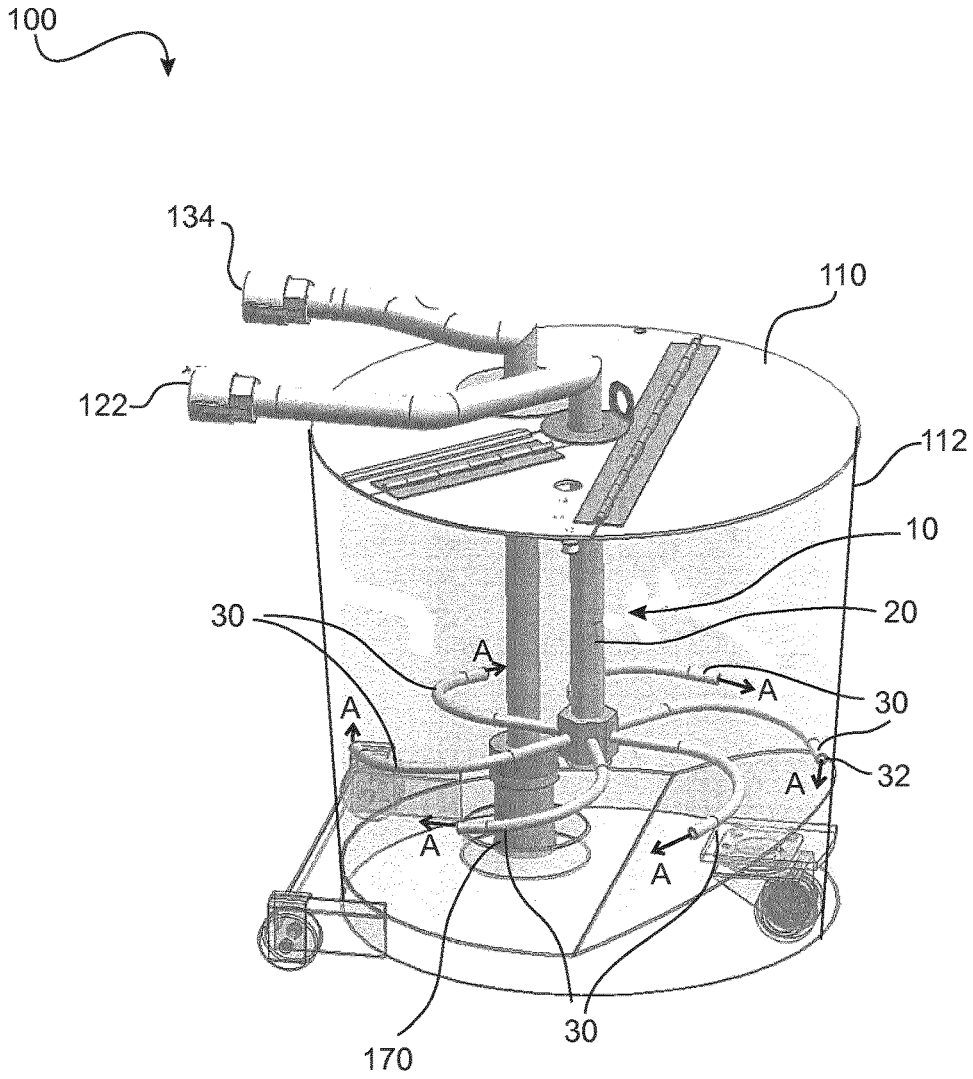
FIG. 2 another embodiment of a fluid system according to the invention.

In FIG. 2 another embodiment of the fluid system 100 according to the invention is shown. These connections serve for a fluid communicating connection with the suction side 122 of the flow pump 120 and the pressure side 134 of the return flow pump 130. In this embodiment the container 110 has a container bottom and a container wall 112, which are overall shaped in a mainly cylindrical formation of the container 110. The single outlet arms 30 are assembled with outlet directions A for the outlet opening 32 which are assembled mainly tangential alongside the mutual coverage U via a curving of the outlet arms 30. Moreover the container bottom of the container 110 is tapered at least one side, so that an application of the fluid in the direction of the pump pit 170 occurs.

FIGS. 3 and 4 show another embodiment of the mixing device 10 according to the invention. Therefore FIG. 3 shows an embodiment with four outlet arms 30, wherein the single outlet openings 32 comprise each an outlet direction A which is assembled tangential or mainly tangential towards the mutual coverage U. Thereby all outlet arms 30 extend radially from the fluid supply 20 away by mainly the same amount, so that a mutual coverage U is produced.

FIG. 4 shows an embodiment of the mixing device 10 by which two outlet arms 30 are intended. This also comprises a mainly equal radial extension, so that a mutual coverage U is formed. However, with this embodiment a horizontal angled positioning via a horizontal angle H of the outlet direction A of both outlet openings 32 is intended. His horizontal angle H lays in the layer which is clamped by the outlet arms 30, between a tangent T to the mutual coverage U and the respective outlet direction A.

Figure 5:
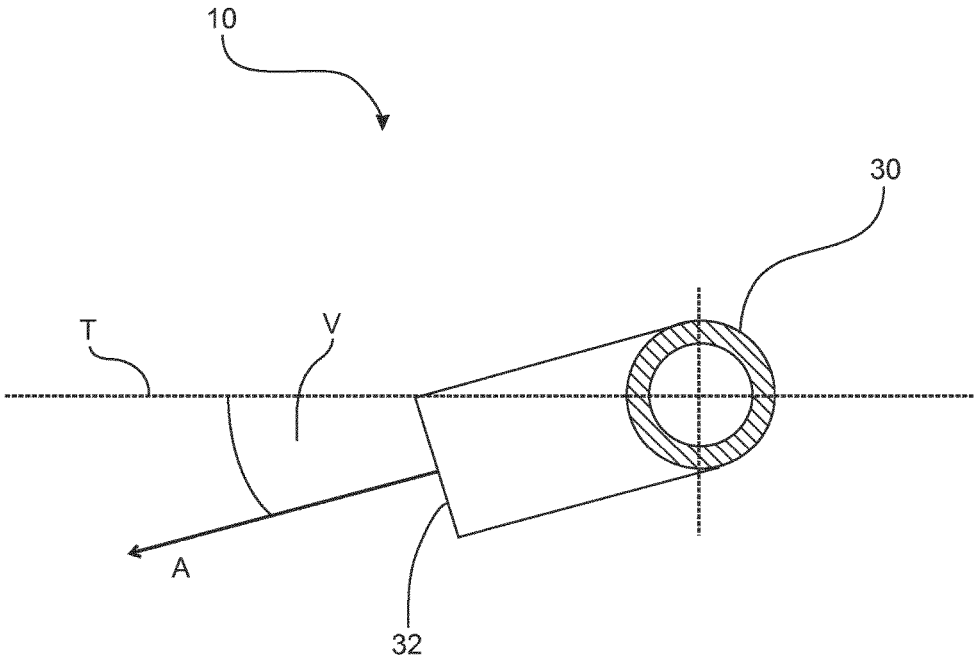
FIG. 5 another embodiment of a mixing device according to the invention.

In FIG. 5 an embodiment is shown, which comprises a vertical positioning with a vertical angle V. According to FIG. 5 the vertical angle V can be defined in a similar way as the horizontal angle H. Thereby by way of example a tangent T is intended at a mutual coverage U, wherein a downwards tilting of the outlet direction A occurs in a vertical direction. It can be easily seen, that a formation of the outlet arm 30 is intended with a mainly round external cross section and a freely round inner cross section.

Figure 6:
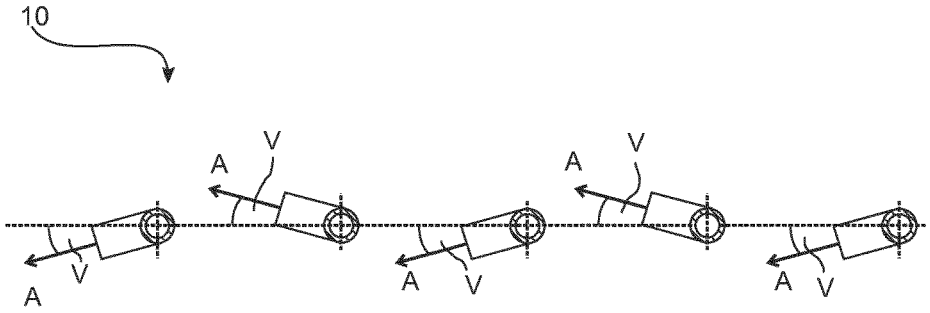
FIG. 6 another embodiment of a mixing device according to the invention.
Figure 7:
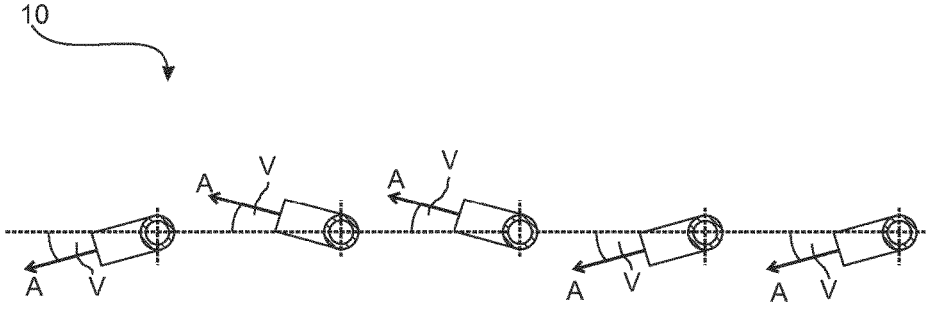
FIG. 7 another embodiment of a mixing device according to the invention.
Figure 8:
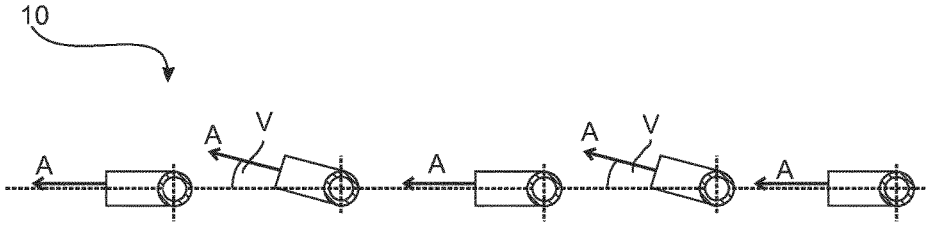
FIG. 8 another embodiment of a mixing device according to the invention.

FIGS. 6, 7 and 8 show three different embodiments of a mixing device 10 according to the invention. For better clarity these three figures show the mixing device 10 in the processing alongside the coverage. FIG. 6 shows an alternative with alternatingly assembled outlet openings 32. The outlet directions A point in different directions according to the horizontal level (shown as a dashed line). The amount of vertical angles V is thereby particularly identical. Each outlet opening 32 is thus adjusted to the bottom layer of the container 110, while each alternating outlet opening 32 points away from the bottom area of the container 110. Thereby a foam forming on the surface of the stored fluid in the container 110 can be effectively avoided. The variation of this embodiment is shown in FIG. 7. A dual alternation is shown. Two outlet openings 32 are each alternatingly pointing in the same direction. FIG. 8 shows an embodiment by which each second outlet opening 32 points upwards. Thereby a minimal embodiment is shown in order to achieve a reduction of the foam forming.

The subsequent explanation of the embodiments describes the present invention exclusively within the scope of examples. Naturally single features of the embodiments in case they are technically reasonable can be freely combined with one another, without leaving the scope of the present invention.

LIST OF REFERENCE NUMBERS

10 mixing device
20 fluid supply
22 additional opening
30 outlet arm
32 outlet opening
100 fluid system
110 container
112 container wall
114 container axis
120 flow pump
120*a* flow valve
122 suction side of the flow pump
124 pressure side of the flow pump
130 return flow pump
130*a* return flow valve
132 suction side of the return flow pump
134 pressure side of the return flow pump
140 fluid receptor
150 fluid tank
160 bypass
160*a* bypass valve
170 pump pit
A outlet direction
V vertical angle
H horizontal angle
U mutual coverage
T tangent

What is claimed is:

1. A fluid system for a dye in a printing machine, comprising:

a mixing device for mixing a fluid in at least one container, a flow pump;

a return flow pump for a conveyance of the fluid, a print roller; and a fluid tank for provision and/or collection of the fluid for and/or from a fluid receptor;

wherein the flow pump is formed for a conveyance of the fluid from the container to the fluid receptor and the return flow pump is formed for a conveyance of the fluid from the fluid tank back to the container, wherein the mixing device comprises a fluid supply connected to at least four outlet arms, each of the at least four outlet arms having an outlet opening connected to the fluid supply in a fluid communicating way, wherein the fluid supply comprises at least one additional opening in an area of connection to the at least four outlet arms so that eventually formed clearance volumes below an area between the fluid supply and the at least four outlet arms are avoided or reduced, wherein an outlet opening is aligned with an outlet direction (A) for the outlet of the fluid, in order to at least partially set the fluid in the at least one container in rotation, wherein said at least one additional opening has an outlet direction alongside an axis of said rotation and toward a bottom of said container, wherein the at least four outlet arms are at least partially curved, wherein the fluid supply of the mixing device is connected with a pressure side of the return flow pump in a fluid communicating way, and wherein the outlet openings of the at least four outlet arms have diverse vertical angles with different signs toward the horizontal level.

2. The fluid system according to claim 1, wherein the at least four outlet arms are arranged in a common level, and wherein each of the diverse vertical angles is in a range between 2° and 7°.

3. The fluid system according to claim 1, wherein a pressure side of the flow pump is connected with a suction side of the return flow pump via a bypass in a fluid communicating way.

4. The fluid system according to claim 1, wherein the outlet opening of the at least four outlet arms is assembled between 20% and 80% of the radial distance between the fluid supply and an encircling wall of the container.

5. The fluid system according to claim 1, wherein the mixing device is assembled towards the container in a rotation stable way.

6. The fluid system according to claim 1, wherein the at least four outlet arms are located within a distance of less than a third of a height of said container from a bottom of said container and are at least one of: arranged in a common level, and are adjusted upwards and downwards, and wherein each of the diverse vertical angles is in a range between 10° and 20°.

7. The fluid system according to claim 1, wherein the at least four au arms are fixed in relation to one another.

* * * * *